US011161003B2

(12) United States Patent
Donner et al.

(10) Patent No.: US 11,161,003 B2
(45) Date of Patent: Nov. 2, 2021

(54) EXERCISE MACHINES HAVING A RESISTANCE FAN THAT DIRECTS AIR FOR COOLING A USER

(71) Applicant: Life Fitness, LLC, Rosemont, IL (US)

(72) Inventors: Matthew A. Donner, Andover, MN (US); Jonathan O. Spence, Lombard, IL (US)

(73) Assignee: Life Fitness, LLC, Rosemont, IL (US)

( * ) Notice: Subject to any disclaimer, the term of this patent is extended or adjusted under 35 U.S.C. 154(b) by 140 days.

(21) Appl. No.: 16/595,679

(22) Filed: Oct. 8, 2019

(65) Prior Publication Data

US 2021/0101042 A1 Apr. 8, 2021

(51) Int. Cl.
*A63B 21/008* (2006.01)
*A63B 22/06* (2006.01)

(52) U.S. Cl.
CPC ..... *A63B 21/0088* (2013.01); *A63B 22/0605* (2013.01); *A63B 2220/76* (2013.01)

(58) Field of Classification Search
CPC ..... A63B 21/0088; A63B 22/0605; A63B 22/0046; A63B 22/001; A63B 2220/76; A63B 2225/66
See application file for complete search history.

(56) References Cited

U.S. PATENT DOCUMENTS 4,589,656 A 5/1986 Baldwin
4,743,011 A 5/1988 Coffey
4,932,650 A 6/1990 Bingham et al.
5,290,212 A * 3/1994 Metcalf ..... A63B 21/0088 482/111
5,920,212 A 7/1999 Han
6,960,156 B2 11/2005 Smith
10,155,132 B2 12/2018 Jones et al.
10,300,321 B2 * 5/2019 Hsu ..... A63B 22/001
2002/0137601 A1 9/2002 Tobias et al.
2003/0216227 A1 11/2003 Smith
2017/0274238 A1 9/2017 Chou

OTHER PUBLICATIONS

Website: https://www.youtube.com/watch?v=VLdoBAVPQe4 posted: Jan. 30, 2017 retrieved: Apr. 20, 2021 (Year: 2017).*
Extended European Search Report for 20199567.7 dated Feb. 26, 2021.

* cited by examiner

*Primary Examiner* — Megan Anderson
(74) *Attorney, Agent, or Firm* — Andrus Intellectual Property Law, LLP

(57) ABSTRACT

An exercise machine has a supporting frame; a resistance fan on the supporting frame, the resistance fan being configured to provide an amount of resistance to a user of the exercise machine; a housing enclosing the resistance fan, the housing having a plurality of openings through which air from the resistance fan is directed towards the user of the exercise machine; and a shroud on the housing. The shroud is movable with respect to the plurality of openings so as to redirect the air from the resistance fan without changing the amount of resistance provided to the user of the exercise machine.

10 Claims, 6 Drawing Sheets

EXERCISE MACHINES HAVING A RESISTANCE FAN THAT DIRECTS AIR FOR COOLING A USER

FIELD

The present disclosure relates to exercise machines, for example stationary cycles having a resistance fan that directs air for cooling a user.

BACKGROUND

U.S. Pat. No. 4,589,656 discloses a device for aerobic exercise having an elongate frame, a housing enclosing the frame, a stress imposing pedal-driven fan carried by one end portion of the frame and a user supporting and positioning seat carried by the other end portion of the frame opposite the fan. The positioning seat has a seat portion inclined from front to rear at a predetermined acute angle to the horizontal, and a backrest portion inclined at a predetermined acute angle to the vertical, with at least the backrest portion having ventilation openings therein which communicate with the front and rear surfaces of the backrest portion. Air passages communicate with the discharge side of the fan and also with the ventilation openings in the backrest portion and serve for directing air discharged by the fan through the ventilation openings to the forward surface of the backrest portion and outwardly therefrom whereby the air cools the user and substantially increases the user's comfort, particularly during long periods of use.

U.S. Pat. No. 4,932,650 discloses an exercise cycle having a frame, a pedal actuated gear arrangement and an impeller, mechanically associated with that gearing arrangement. The impeller is housed within a chamber defined within a housing mounted on the frame. The chamber includes an inlet opening for introducing a stream of environmental air into the chamber and an outlet opening adapted for directing a flow of pressurized air generated by the impeller's rotation over the body of the user.

U.S. Pat. No. 5,920,212 discloses an exercise cycle including a frame having a front wheel assembly and handlebars. The front wheel assembly includes a fan wheel having side plates one of which has an intake port, and an intake assembly around the intake port, the intake assembly having openings which may be opened and closed. By opening and closing the intake openings, the resistance of the wheel to the air can be varied without changing the rotational rate of the wheel. The handlebars of the exercise cycle are pivotally connected to the cycle intermediate their ends. The lower ends of the handlebars are pivotally connected to a cam arm which is removably connected to the shaft to which the pedal is mounted. By connecting or disconnecting the cam arm to or from the pedal shaft, the handlebars can be selectively moved between a stationary mode and a mode in which the handlebars reciprocate between forward and backward positions.

U.S. Pat. No. 6,960,156 discloses a device for directing a concentrated airflow at the user of an air resisted exercise machine. The cowling is constructed from either a semi-rigid material or low-porosity fabric and can be removably attached to the cage covering the fan type blades usually associated with such machines. Various means can be used to attach the device to the cage, one means being the use of elastic cords routed through welts. In use, the device of the current invention directs air at the user of the machine. The device is lightweight and portable, and a user can carry the device along for use on machines in a variety of places.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter. In certain examples disclosed herein: an exercise machine has a supporting frame; a resistance fan on the supporting frame, the resistance fan being configured to provide an amount of resistance to a user of the exercise machine; a housing enclosing the resistance fan, the housing having a plurality of openings through which air from the resistance fan is directed towards the user of the exercise machine; and a shroud on the housing. The shroud is movable with respect to the plurality of openings so as to redirect the air from the resistance fan without changing the amount of resistance provided to the user of the exercise machine.

BRIEF DESCRIPTION OF THE DRAWINGS

Examples of exercise machines are herein disclosed with reference to the following drawing figures. The same numbers are used throughout to reference like features and components.

DETAILED DESCRIPTION

Through research and development, the present inventors have determined that conventional stationary exercise machines having resistance fans do not provide the user with the ability to change a flow of air contacting them during use without also modifying the level of resistance provided by the resistance fan. In particular, the present inventors realize that the total surface area of the fan housing through which the air can flow will affect the resistance encountered by the fan. The prior art mentioned herein above allows the user to change the direction of airflow through the fan housing; however only in arrangements that also change the noted cross-sectional area and thus the resistance. This is disadvantageous. Upon this realization, the present inventors endeavored to provide an exercise machine, in particular a stationary exercise machine, that overcomes these disadvantages of the prior art. The present disclosure is a result of these efforts.

Figure 1:
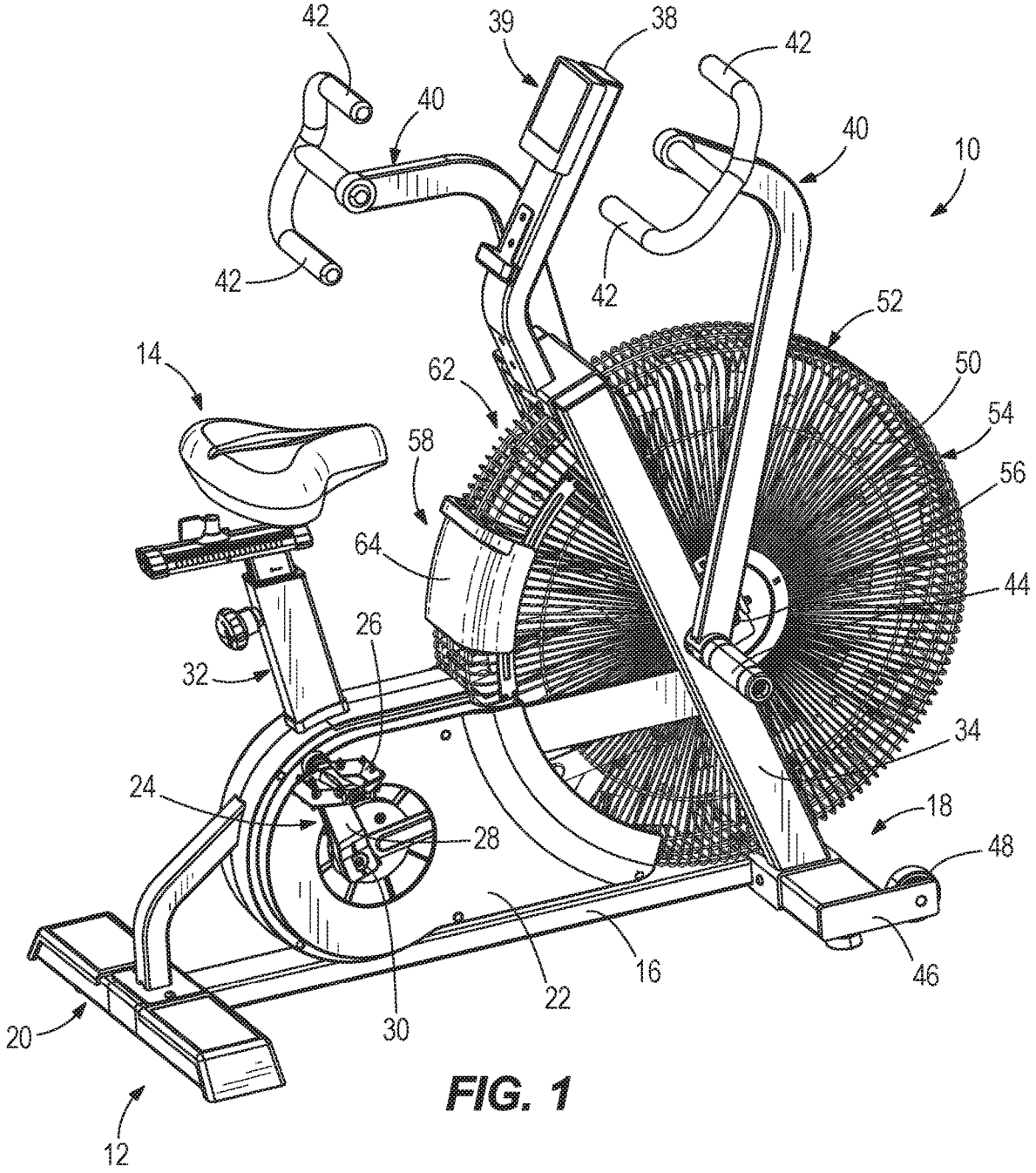
FIG. 1 is a perspective view of an exercise machine according to the present disclosure, which in the illustrated example is a stationary cycle.
Figure 2:
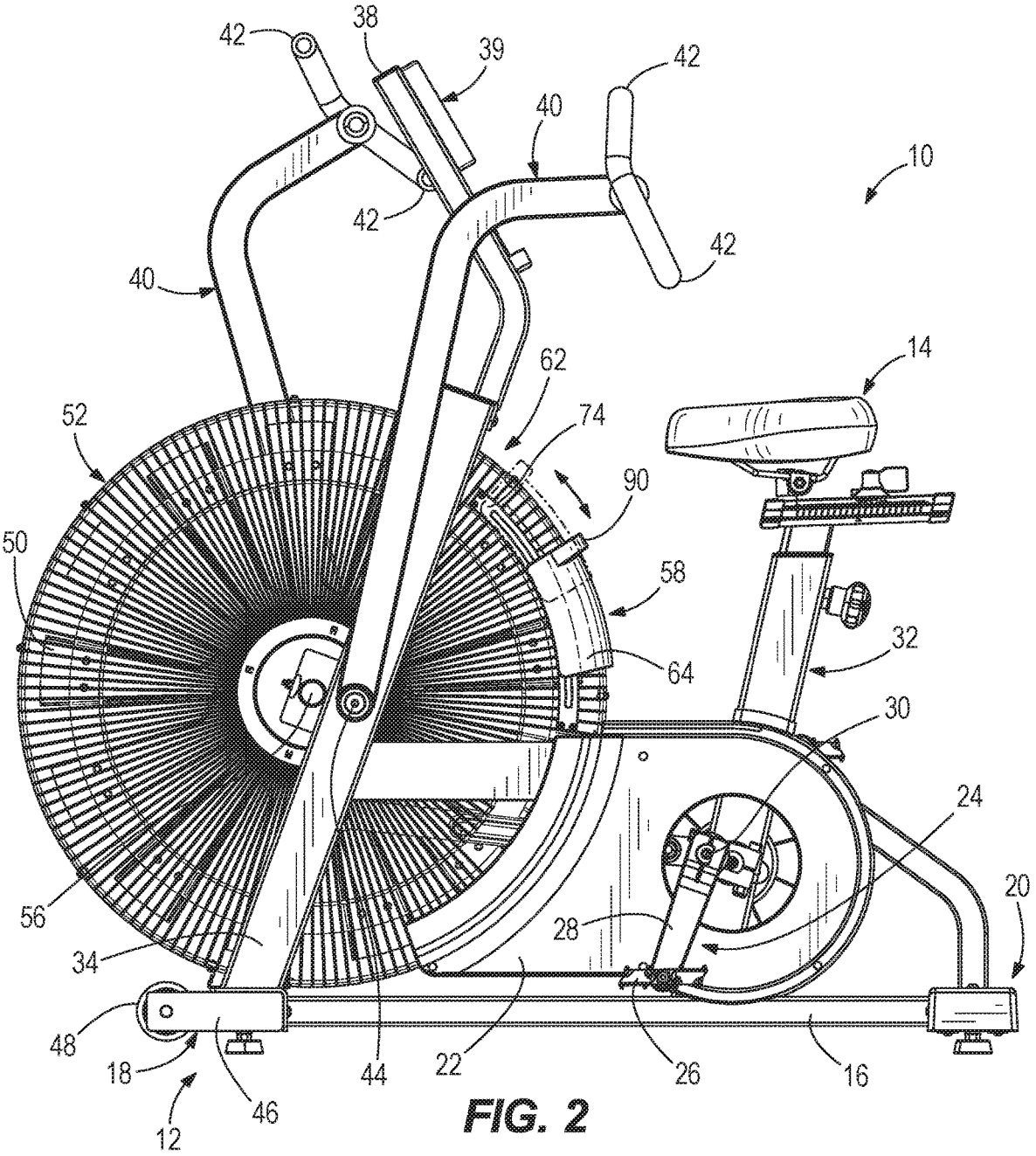
FIG. 2 is a side view of the stationary cycle.
Figure 3:
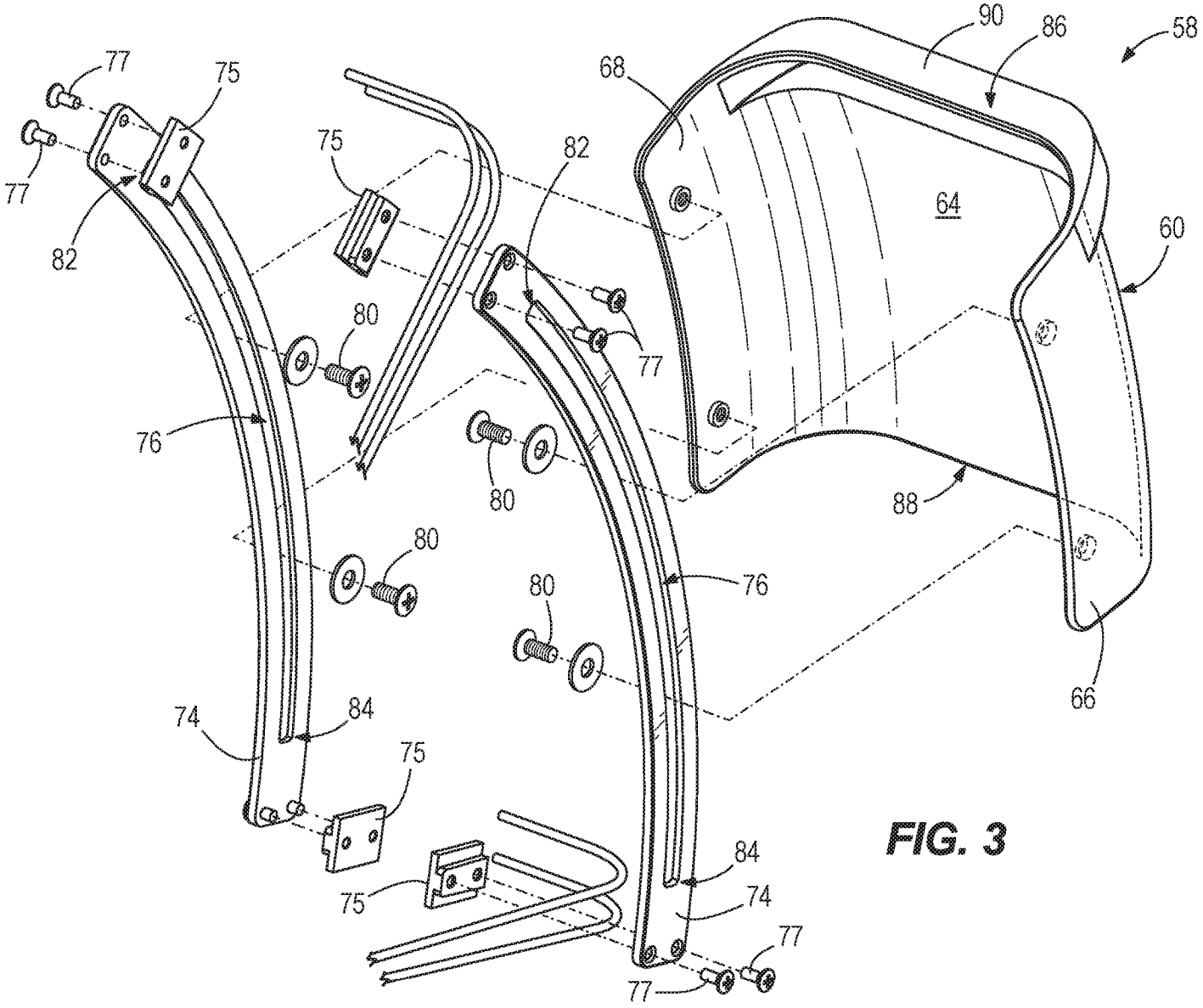
FIG. 3 is an exploded view of a shroud that is configured to redirect air from a resistance fan of the stationary cycle.

FIGS. 1-3 depict a stationary exercise machine according to the present disclosure, which in the illustrated example is a stationary cycle 10. The stationary cycle has a supporting frame 12 that supports an adjustable seat 14 with respect to the ground. The supporting frame 12 has an axially elongated base member 16 and transversely elongated forward and rearward brace members 18, 20. A pedal housing 22 contains a pair of pedal members 24. Each pedal member 24 has a pedal 26 for supporting a user's foot and a crank arm 28 coupled to a laterally extending pedal axle 30. A seat pedestal 32 extends vertically upwardly from the pedal housing 22 and supports the seat 14. Optionally, the position of the seat 14 can be adjusted relative to the seat pedestal 32 to accommodate users of different height, as is conventional and for example disclosed in U.S. Pat. No. 8,496,297, which is incorporated herein by reference. A forked, angularly extending support pillar 34 extends upwardly from the forward brace member 18 and has a support bracket 38 on its upper end for supporting a display panel, control panel, and/or the like 39, for use by the user sitting on the seat 14. A pair of handle members 40 are pivot-ably coupled to the support pillar 34, each having a handlebar 42 that can be manually grasped by the user sitting on the seat 14. The handle members 40 are manually pivotable back and forth relative to each other and to the support pillar 34. The type and configuration of the handlebar 42 can also vary from what is shown. Optionally, a pair of stationary foot support pegs 44 are fixed to and laterally extend from the support pillar 34, and are for supporting a user's feet when the pedal members 24 are not being operated by the user. A pair of wheel brackets 46 extend forwardly from opposite ends of the forward brace member 18 and have wheels 48 facilitating transport of the stationary cycle 10 during periods of non-use. As is conventional, the supporting frame 12 can be pivoted forwardly about the wheel brackets 46 to thereby raise the rearward brace member 20 off the ground and allow the supporting frame 12 to be rolled along the ground via wheels 48.

A resistance fan 50 is supported on the supporting frame 12, and particularly located within a housing 52, which in the illustrated example is a wire grate having a plurality of openings 54 (shown best in FIGS. 4-6) defined by gaps within the wire grate. The resistance fan 50 has a generally circular outer profile and rotates about a center axle 56. The resistance fan 50 is operably coupled to the pedal members 24 by for example gearing and/or belt(s) and/or chain(s) and/or the like (not shown) such that operating the pedal members 24 (i.e., pedaling the pedal members 24 with respect to the pedal axle 30) rotates the resistance fan 50 about the center axle 56. Optionally the resistance fan 50 is also operatively coupled to the handle members 40 by for example gearing and/or belt(s) and/or chain(s) and/or the like (not shown) such that operating the handlebars 42 (i.e., pushing and/or pulling the handlebars 42 back and forth with respect to the support pillar 34) rotates the resistance fan 50 about the center axle 56, all as is conventional.

Figure 4:
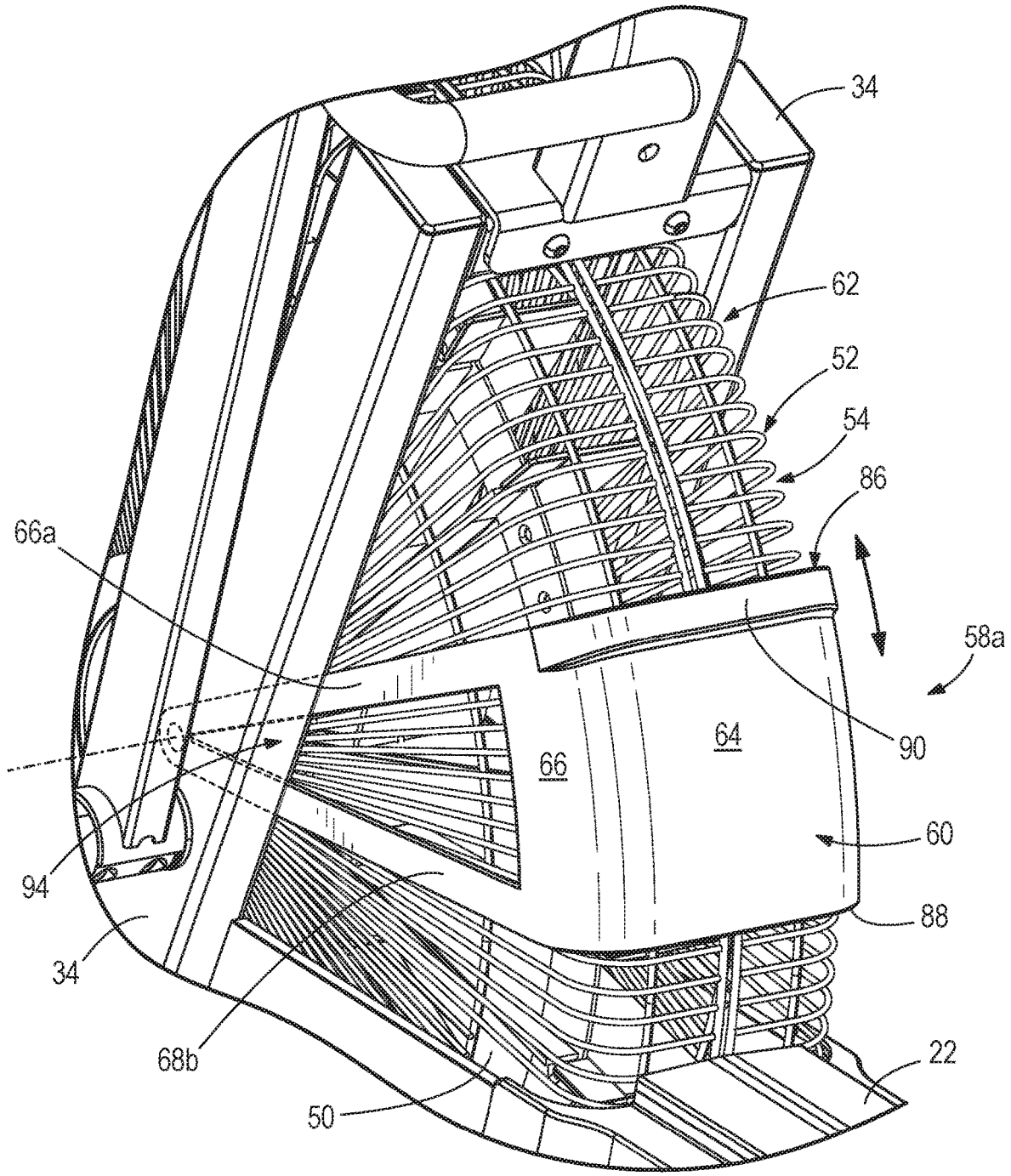
FIG. 4 is a second example of the shroud on the housing of the resistance fan.
Figure 5:
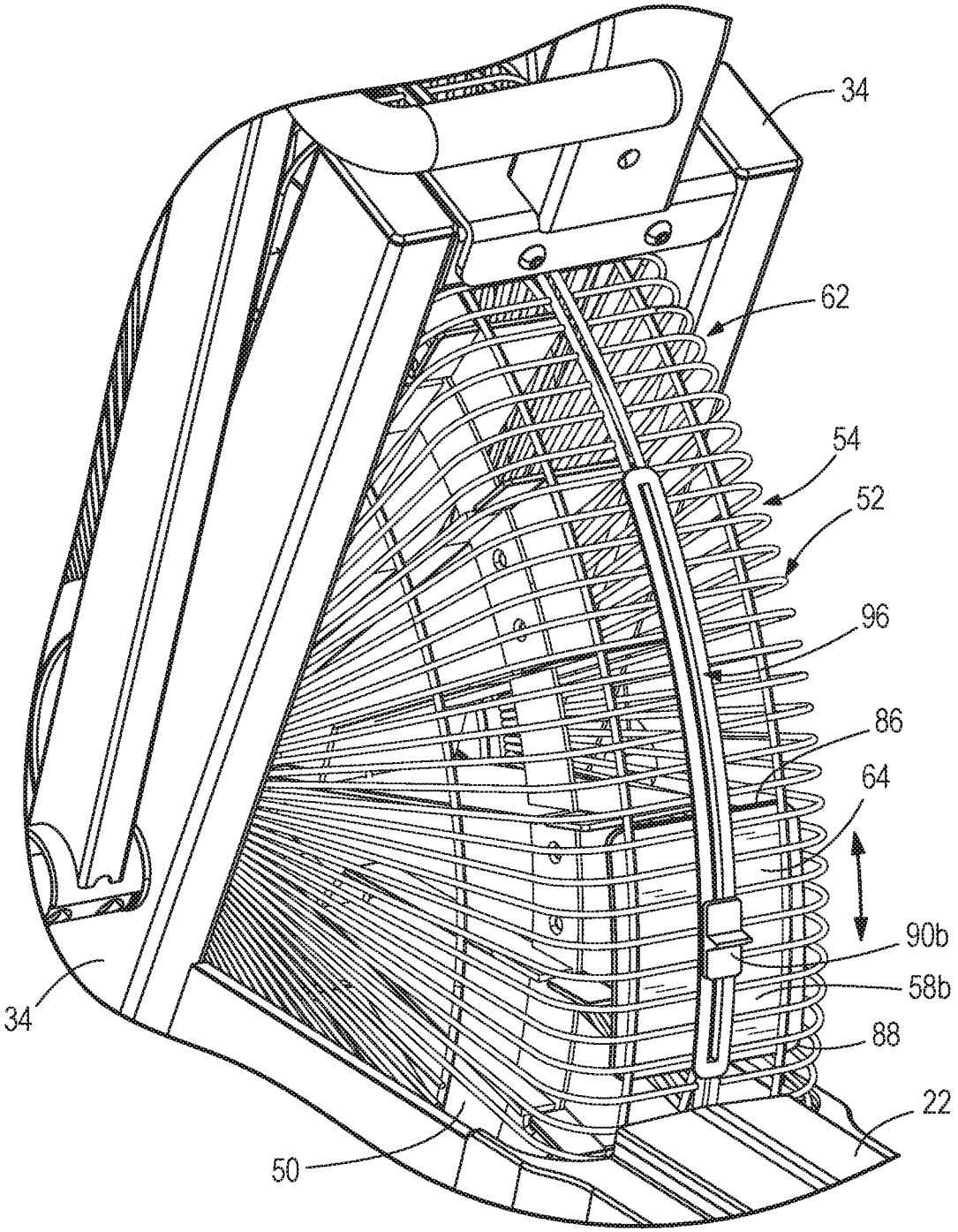
FIG. 5 is a third example of the shroud on the housing of the resistance fan.
Figure 6:
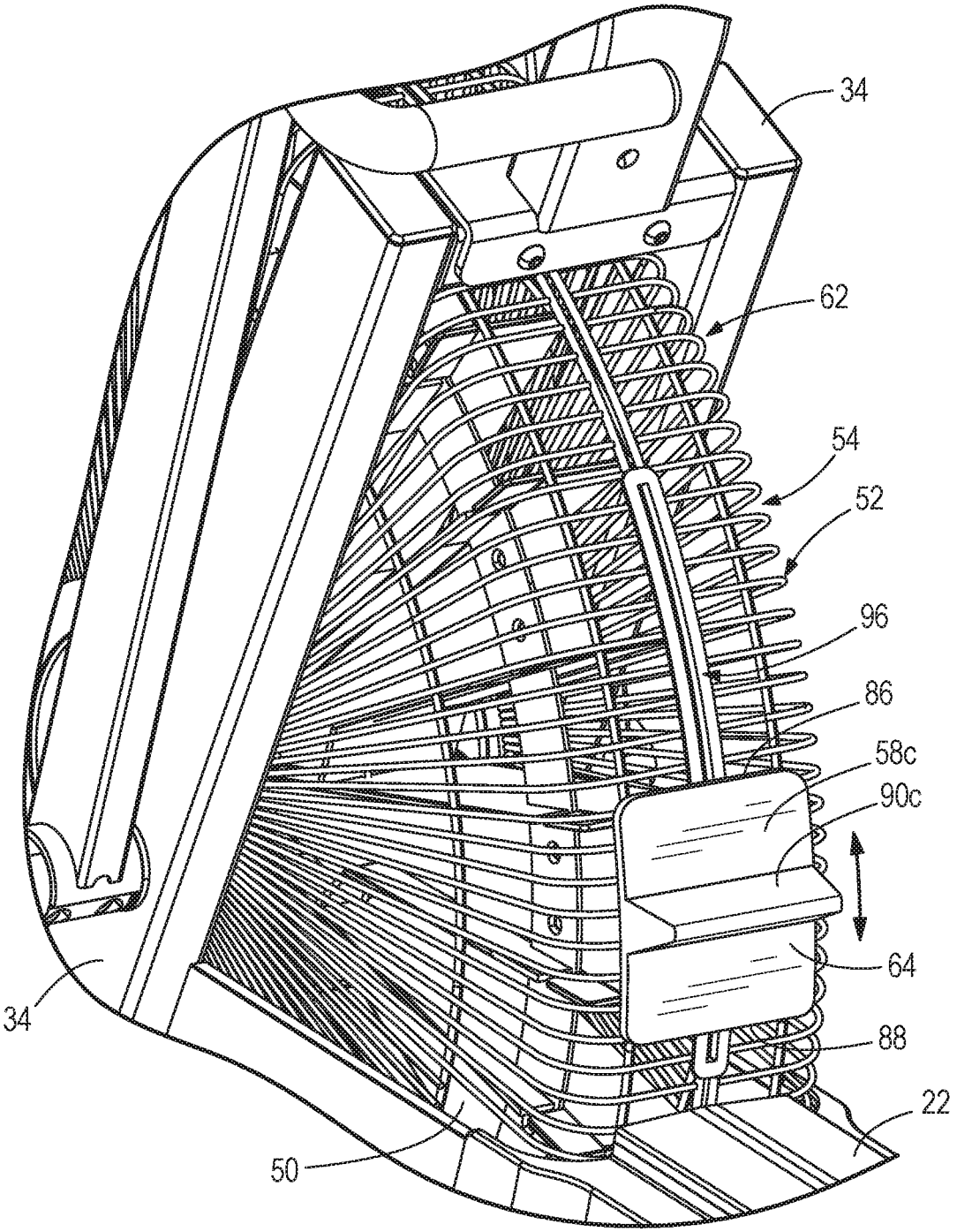
FIG. 6 is a fourth example of the shroud on the housing of the resistance fan.

Referring briefly to FIGS. 4-6, the resistance fan 50 has contours (e.g. ridges, plates, holes, slots, curvatures, etc.) such that when rotated, the resistance fan 50 encounters resistance from the surrounding air, which resistance in turn is applied to the user pedaling the pedal members 24 and/or operating the handle members 40, all as is conventional. Thus, the resistance fan 50 is configured to provide resistance to the user of the stationary cycle 10 via the pedal members 24 and/or handlebars 42, all as is conventional. The air that is encountered by the resistance fan 50 is forced outwardly away from the resistance fan 50 and towards the through the openings 54 in the housing 52. The particular contours of the resistance fan 50 can vary, examples of which are known in the art and for example disclosed in the above-referenced patents. The manner in which the resistance fan 50 is operably coupled to the pedal members 24 can vary, examples of which are known in the art and for example disclosed in the above-referenced patents. The manner in which the resistance fan 50 is operably coupled to the handle members 40 is conventional and can vary. Examples of conventional stationary cycles are disclosed in U.S. Pat. No. 6,913,560, which is incorporated herein by reference.

Referring now to FIGS. 1-3, according to the present disclosure, a novel, movable shroud 58 is located on the housing 52, and particularly on a rearward side of the housing 52, between the seat 14 and the handle members 40. Optionally, a fixed cowling (not shown) can be located on the housing 52, and particularly on the portions of the housing 52 located forwardly of the support pillar 34, and thus preventing flow of air through the housing 52 at the locations of the fixed cowling. In the example shown in FIG. 3, the movable shroud 58 includes a generally U-shaped sleeve 60 disposed on the rear, radially outer perimeter 62 of the housing 52. The sleeve 60 has a body 64 and opposing first and second arms 66, 68 that together form the U-shape. The first and second arms 66, 68 are coupled to axially opposite side faces of the housing 52 via arcuate tracks 74. The arcuate tracks 74 are fixed to the opposing side faces via backing brackets 75 and fasteners 77. The arcuate tracks 74 have elongated slots 76 that generally follow the profile of the radially outer perimeter 62 of the housing 52. A pair of fasteners 80 extend through the first and second arms 66, 68 and are disposed in and configured to slide along the arcuate tracks 74, and thus facilitate sliding movement of the sleeve 60 along the arcuate tracks 74 and along the rear, radially outer perimeter 62 of the housing 52. Engagement between the fasteners 80 with the opposite ends 82, 84 of the slots 76 defines first and second extreme positions into which the shroud 58 is slide-able with respect to the housing 52. The sleeve 60 has a leading edge 86 and an opposite, trailing edge 88, and a handle 90 located proximate to the leading edge 86 and facilitating manual grasping and sliding of the sleeve 60 with respect to the housing 52 into and between the noted extreme positions.

The plurality of openings 54 in the wire grate that are not covered by the noted fixed cowling thus define a total cross-sectional area through which the air flows through the housing 52. The plurality of openings 54 is defined, at least in part, along the radially outer perimeter 62 of the housing 52, which is along the housing 52 between the pedal members 24 and the handle members 40, such that air encountered by the resistance fan 50 is forced radially from the housing 52 and directed onto the user sitting on the seat 14. This forces air onto and cools the user sitting on the seat 14. Each opening 54 directs the air from the resistance fan 50 in a slightly different respective radial direction. A portion of the total cross-sectional area for flow of air through the housing 52 is blocked by the shroud 58. The total cross-sectional area of the housing 52 through which air can flow is a factor that determines the amount of resistance provided by the fan 50. The greater the cross-sectional area, the less resistance provided by the fan 50, and vice versa. Advantageously, the shroud 58 is configured so as to be movable with respect to the plurality of openings 54 so as to redirect the air from the resistance fan 50 without changing the amount of resistance provided to the user of the stationary cycle 10. In particular, as the shroud 58 is moved along the radially outer perimeter 62 of the housing 52, the trailing edge 88 uncovers a portion of the total cross-sectional area of the plurality of openings 54 as the leading edge 86 simultaneously covers an equal portion of the total cross-sectional area of the plurality of openings 54. In other words, the shroud 58 is movable with respect to the housing 52 into and between a plurality of positions; however in each position an equal portion of the air from the resistance fan 50 is blocked and/or redirected. This causes the total resistance provided by the resistance fan 50 to the user to remain unchanged during and after said movement. As the shroud 58 is moved into and between the extreme positions defined by engagement between the tabs 80 and the ends 82, 84 of the arcuate tracks 74, the shroud 58 continuously covers an equal portion of the cross-sectional area, thus causing the resistance provided by the resistance fan 50 to remain unchanged. That is, in all positions along the radially outer perimeter 62 of the housing 52, the shroud 58 advantageously covers an equal portion of the total cross-sectional area, thus leaving the total resistance provided by the resistance fan 50 unchanged.

FIG. 4 depicts another example of a shroud 58*a* according to the present disclosure. Like reference numbers are used for like components shown in the example of FIGS. 1-3. In this example, instead of being coupled to the housing 52 via the above-described arcuate tracks 74, the shroud 58*a* has elongated first and second arms 66*a*, 68*b* that are pivot-ably coupled to the housing 52 and/or support pillar 34, and thus pivotable about a lateral pivot axis 92. An opening 94 is defined between the first and second arms 66*a*, 66*b* through which air from the resistance fan 50 can pass. In all positions along the radially outer perimeter 62 of the housing 52, the shroud 58*a* advantageously covers an equal portion of the total cross-sectional area, thus leaving the total resistance provided by the resistance fan 50 unchanged.

FIG. 5 depicts another example of a shroud 58*b* according to the present disclosure. Like reference numbers are used for like components shown in the example of FIGS. 1-3. The shroud 58*b* differs from what is shown in FIGS. 1-3 in that it has a body 64 that is disposed inside of the housing 52. In this example, an elongated track 96 is formed through the radially outer perimeter 62 of the housing 52. The shroud 58*b* has a handle 90*b* that extends through the elongated track 96 and facilitates manual sliding of the shroud 58*b* along the interior of the radially outer perimeter 62 of the housing 52 into and between extreme first and second positions, all as described herein above. In all positions along the radially outer perimeter 62 of the housing 52, the shroud 58*b* advantageously covers an equal portion of the total cross-sectional area, thus leaving the total resistance provided by the resistance fan 50 unchanged.

FIG. 6 depicts another example of a shroud 58*a* according to the present disclosure. Like reference numbers are used for like components shown in the example of FIGS. 1-3. Like the example shown in FIG. 5, an elongated track 96 is formed through the radially outer perimeter 62 of the housing 52. The shroud 58*c* differs from what is shown in FIG. 5, in that the body 64 is disposed outside of the housing 52 and is slide-ably engaged with the elongated track 96 (via for example a pin or tab, not shown, that extends through the elongated track 96 in a relationship similar to the engagement between the handle 90*b* shown in FIG. 5). The shroud 58*c* has a handle 90*c* that facilitates manual sliding of the shroud 58*c* along the exterior of the radially outer perimeter 62 of the housing 52 into and between extreme first and second positions, all as described herein above. In all positions along the radially outer perimeter 62 of the housing 52, the shroud 58*c* advantageously covers an equal portion of the total cross-sectional area, thus leaving the total resistance provided by the resistance fan 50 unchanged.

In other examples, the stationary cycle 10 can include a user-operable control unit 39, such as disclosed in U.S. Pat. No. 10,071,286, which is incorporated herein by reference. The user-operable control unit can for example be mounted on the support bracket 38 and be programmed to automatically move the shroud 58, 58*a*-58*c*, via for example an electric motor, hydraulic actuator, or any other similar known actuation device for moving components on an exercise machine. Such a mechanism can be powered by electricity, for example as disclosed in U.S. Pat. No. 9,943,718, which is incorporated herein by reference. Automatically controlling movement of the shroud 58 can be based on user inputs to the noted user-operable control unit and/or programmed exercise routines run by the control unit, and/or based on current characteristics of the user (e.g., the user's heart-rate) as sensed by biometric sensors, all as well known in the art, one example being disclosed in U.S. Pat. No. 8,082,029, which is incorporated herein by reference.

The present disclosure thus advantageously provides a novel exercise cycle having supporting frame; pedals for performing a cycling exercise motion relative to the supporting frame; and a resistance fan operatively coupled to the pedals such that performance of the cycling exercise motion causes rotation of the resistance fan, which thereby provides an amount of resistance to the cycling exercise motion via the pedals. A housing encloses the resistance fan and having a plurality of openings through which air from the resistance fan is directed towards a user of the exercise cycle. A shroud is located on the housing and is movable with respect to the plurality of openings so as to redirect the air from the resistance fan without changing the amount of resistance provided to the user of the exercise cycle.

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. An exercise machine comprising:

a supporting frame;

a resistance fan on the supporting frame, the resistance fan being configured to provide an amount of resistance to a user of the exercise machine;

a housing enclosing the resistance fan, the housing having a plurality of openings through which air from the resistance fan is directed towards the user of the exercise machine;

wherein the housing comprises axially opposite side faces and a radially outer perimeter, and wherein the plurality of openings are disposed along the radially outer perimeter; and a shroud coupled to the housing, the shroud being movable with respect to the plurality of openings so as to redirect the air from the resistance fan without changing the amount of resistance provided to the user of the exercise machine;

the shroud comprising a sleeve having first and second arms that together form a U-shape, and further comprising arcuate tracks on the axially opposite side faces, wherein the first and second arms are engaged with and slide along the arcuate tracks.

2. The exercise machine according to claim 1, wherein the sleeve comprises a leading edge and an opposite, trailing edge, and wherein as the shroud is moved along the housing, the opposite, trailing edge uncovers a portion of the plurality of openings as the leading edge covers a respectively equal portion of the plurality of openings.

3. The exercise machine according to claim 1, wherein the housing comprises a wire grate and wherein the plurality of openings are defined by gaps within the wire grate.

4. An exercise cycle comprising:

a supporting frame;

pedals for performing a cycling exercise motion relative to the supporting frame;

a resistance fan operatively coupled to the pedals such that performance of the cycling exercise motion causes rotation of the resistance fan, which thereby provides an amount of resistance to the cycling exercise motion;

a housing enclosing the resistance fan, the housing having a plurality of openings through which air from the resistance fan is directed towards a user performing the cycling exercise motion;

wherein the housing comprises axially opposite side faces and a radially outer perimeter, and wherein the plurality of openings are disposed along the radially outer perimeter; and a shroud coupled to the housing, the shroud being movable with respect to the plurality of openings so as to redirect the air from the resistance fan without changing the amount of resistance to the cycling exercise motion;

the shroud comprising a sleeve having first and second arms that together form a U-shape; and further comprising arcuate tracks on the axially opposite side faces, and wherein the first and second arms are engaged with and slide along the arcuate tracks, respectively.

5. The exercise cycle according to claim 4, wherein the housing comprises a wire grate and wherein the plurality of openings are defined by gaps within the wire grate.

6. An exercise machine comprising:

a supporting frame;

a resistance fan on the supporting frame, the resistance fan being configured to provide an amount of resistance to a user of the exercise machine;

a housing enclosing the resistance fan, the housing having a plurality of openings through which air from the resistance fan is directed towards the user of the exercise machine;

wherein the housing comprises a radially outer perimeter, and wherein the plurality of openings are disposed along the radially outer perimeter; and a shroud coupled to the housing, the shroud being movable with respect to the plurality of openings so as to redirect the air from the resistance fan, wherein the shroud comprises a leading edge and an opposite, trailing edge, and wherein as the shroud is moved, the opposite, trailing edge uncovers a portion of the plurality of openings as the leading edge covers a respectively equal portion of the plurality of openings, in particular so as to redirect the air from the resistance fan without changing the amount of resistance provided to the user of the exercise machine;

wherein the shroud is disposed at least partially in an interior of the housing.

7. The exercise machine according to claim 6, further comprising an elongated track on the housing, wherein the shroud has a body disposed in the housing and a handle that extends through the elongated track and facilitates manual sliding of the shroud along the interior of the housing.

8. The exercise machine according to claim 6, further comprising pedals for performing a cycling exercise motion relative to the supporting frame.

9. An exercise machine comprising:

a supporting frame;

a resistance fan on the supporting frame, the resistance fan being configured to provide an amount of resistance to a user of the exercise machine;

a housing enclosing the resistance fan, the housing having a plurality of openings through which air from the resistance fan is directed towards the user of the exercise machine;

wherein the housing comprises a radially outer perimeter, and wherein the plurality of openings are disposed along the radially outer perimeter; and a shroud coupled to the housing, the shroud being movable with respect to the plurality of openings so as to redirect the air from the resistance fan, wherein the shroud comprises a leading edge and an opposite, trailing edge, and wherein as the shroud is moved, the opposite, trailing edge uncovers a portion of the plurality of openings as the leading edge covers a respectively equal portion of the plurality of openings, in particular so as to redirect the air from the resistance fan without changing the amount of resistance provided to the user of the exercise machine; wherein the shroud comprises a sleeve having first and second arms that together form a U-shape, and wherein the elongated track is one of a pair of arcuate tracks on the axially opposite side faces, and further wherein the first and second arms are engaged with and slide along the arcuate tracks;

an elongated track on the housing, wherein the shroud is slide-able along the elongated track.

10. The exercise machine according to claim 9, wherein the housing comprises a wire grate and wherein the plurality of openings are defined by gaps within the wire grate.

* * * * *